United States Patent [19]

Cullen et al.

[11] Patent Number: 4,945,979

[45] Date of Patent: Aug. 7, 1990

[54] ROBOTIC ARM FOR DELIVERING A TUBE PLUGGING TOOL

[75] Inventors: William K. Cullen; Warren E. Lester, both of Pittsburgh; Robert J. Maurer, Monroeville, all of Pa.

[73] Assignee: Westinghouse Electric Corp., Pittsburgh, Pa.

[21] Appl. No.: 210,222

[22] Filed: Jun. 23, 1988

[51] Int. Cl.[5] ..... F28F 11/06

[52] U.S. Cl. ..... 165/76; 29/726; 29/809; 901/41; 901/45

[58] Field of Search ..... 165/11.1, 71, 76; 29/723, 726, 809; 414/146; 901/41, 45

[56] References Cited

U.S. PATENT DOCUMENTS

| | | | |
|---|---|---|---|
| 3,535,764 | 10/1970 | Hoffman | 29/809 X |
| 4,173,060 | 11/1979 | Massaro, Jr. et al. . | |
| 4,205,939 | 6/1980 | Reyes . | |
| 4,205,940 | 6/1980 | Golick . | |
| 4,222,699 | 9/1980 | Dunn et al. . | |
| 4,271,471 | 6/1981 | Castner . | |
| 4,309,809 | 1/1982 | Yokoe et al. . | |
| 4,347,652 | 9/1982 | Cooper, Jr. et al. . | |
| 4,369,662 | 1/1983 | Rieben et al. . | |
| 4,414,750 | 11/1983 | DeFazio | 901/45 X |
| 4,438,805 | 3/1984 | Gugel | 165/76 |
| 4,521,844 | 6/1985 | Sturges, Jr. et al. | 364/167 |
| 4,672,741 | 6/1987 | Zafred et al. . | |
| 4,673,027 | 6/1987 | Vermaat . | |

FOREIGN PATENT DOCUMENTS

| | | | |
|---|---|---|---|
| 62-188634 | 8/1987 | Japan | 29/809 |
| 1058100 | 11/1983 | U.S.S.R. | 29/809 |

*Primary Examiner*—Martin P. Schwadron
*Assistant Examiner*—Allen J. Flanigan

[57] ABSTRACT

An improved robotic arm for effecting a tube plugging operation is disclosed herein. The improvement generally comprises the provision of a compliance coupling between the plugging tool and the guidance mechanism of the robotic arm that is compliant in three dimensions, thereby allowing the plugging tool to smoothly insert tube plugs into the mouths of heat exchanger tubes despite inaccuracies in alignment caused by sag and other factors. The improvement further comprises a length adjustment assembly for allowing the length of the base arm of the robotic arm to be easily and conveniently changed so that the robotic arm can service more than one particular type of nuclear steam generator, as well as an emergency release mechanism for remotely detaching the tool from the arm in the event of a jam. Finally, a rotary-type tube plug magazine is provided which includes a spring loaded drum having a plurality of spring clips mounted around its periphery for detachably retaining a large inventory of tube plugs and unloading these plugs without scratching. A stop mechanism with rollers prevents the tube plugs retained by the spring clips from rotating past an unloading position where the plugging tool can engage and smoothly remove the plug. Once a plug is removed at the unloading station, the torsional spring rotates the drum to advance another tube plug to the unloading position, where it may likewise be unloaded into the plugging tool.

19 Claims, 7 Drawing Sheets

ROBOTIC ARM FOR DELIVERING A TUBE PLUGGING TOOL

BACKGROUND OF THE INVENTION

This invention generally relates to a device for delivering a plugging tool within a steam generator, and is specifically concerned with an improved robotic arm for delivering and positioning a plugging tool into the open end of a heat exchanger tube mounted within the tube sheet of a nuclear steam generator.

Robotic arms for delivering and positioning plugging tools are known in the prior art. One of the most practical and effective of these known devices is the robotic arm disclosed and claimed in U.S. Pat. No. 4,672,752 invented by Paolo R. Zafred et al and assigned to the Westinghouse Electric Corporation, the entire specification of which is incorporated herein by reference. This particular robotic arm generally comprises a support member which is detachably connectable onto a man way of the channel head of a nuclear steam generator, and a base arm which is pivotally connected to the support member. The base arm includes a guidance mechanism and a positioning mechanism. The guidance mechanism aligns and inserts the tool into the open end of the tube to be plugged, and includes a lifting cylinder and a two-dimensional compliance coupling for this purpose. The positioning mechanism is connected to the guidance mechanism and serves to pivotally move the plugging tool between a plug installing and a plug loading position. A plug magazine is supported on the base arm for supplying the plugging tool with tube plugs. The plugging tool may incorporate the mechanism described and claimed in U.S. Pat. No. 4,369,662 to Reiben et al and assigned to the Westinghouse Electric Corporation. The tube plugs may be of the type disclosed in U.S. Pat. No. 4,390,042 to Kucherer et al and assigned to the Westinghouse Electric Corporation.

In operation, the support member of the robotic arm is bolted onto the channel head of a nuclear steam generator at the periphery of the man way. The base arm is pivoted upwardly and locked into a position that it is essentially parallel with the tube sheet of the steam generator. The base arm is rotatably manipulated by a gear train attached to an electric motor which is remotely controlled by an operator who monitors the position of the plugging tool by way of a TV camera. When the plugging tool is aligned with the open end of a tube to be plugged, a pneumatic cylinder included within the guidance mechanism swings the plugging tool 90 degrees from a horizontal, plug-loading position to a vertical, plug-installing position just under the open end of the tube to be plugged. The pneumatic cylinder included within the guidance mechanism lifts and inserts the plugging tool into engagement with the open end of the tube. The plug is then radially expanded in order to firmlY seal it around the open end of the tube, after which it is released by the plugging tool. The positioning mechanism then swings the plugging tool 90 degrees back into a horizontal position and into the plug magazine in order to load an additional plug into the plugging tool. After the loading operating has been completed, the process is repeated until all of the defective tubes are plugged.

While the robotic arm disclosed and claimed in U.S. Pat. No. 4,672,741 represents a major advance in the art, the applicants have observed that there are at least four limitations associated with this arm that have prevented it from realizing its full potential. First, while this tool does provide a compliance coupling between the plugging tool and the positioning mechanism which ultimately connects the tool to the base arm, the inability of this compliance coupling to afford three-dimensional movement to the plugging tool seriously impairs its ability to compensate for small axial misalignments between the center line of the plug held by the plugging tool, and the open end of a heat exchanger tube that receives this plug. Consequently, the two-dimensional compliance afforded by this particular coupling has caused an undesirable amount of friction and stress between the plug and the mouth of the tube during the plugging operation, which has in turn led to binding of the tool within the tube. Secondly, the fixed length of the base arm in this particular robotic arm makes it impossible to use the same robotic arm in different models of steam generators due to the different dimensions of the channel head of such generators. Thirdly, the applicants have observed that there is no convenient way to detach the plugging tool from the rest of the robotic arm in the event that the tool becomes bound or jammed with respect to a particular tube. This is a serious shortcoming, as the jammed tool can obstruct the man way of the channel head to such an extent that it becomes dangerous or impossible for a maintenance worker to enter the channel head and unjam the device, as the worker might have difficulties in leaving the radioactive environment of the channel head even if he were able to climb over the device and successfully enter the generator. Finally, the staggered clip-type tube plug magazine used in this prior art robotic arm does not always provide a completely smooth unloading of the tube plugs, which can cause scratches in the plugs. These scratches can in turn jeopardize the integrity of the resulting plug seal. Moreover, this clip-type magazine has a limited storage capacity for tube plugs, which necessitates a relatively frequent refilling of the magazine by a maintenance operator, thereby necessitating the exposure of an operator to significant amounts of radiation.

Clearly, there is a need for an improved robotic arm for effecting a plugging operation which is capable of smoothly and reliably plugging the open ends of heat exchanger tubes in the tube sheets of steam generators without the generation of binding or excessive stresses between the tube plugs and the heat exchanger tubes being plugged, and without the scratching of the plugs as they are withdrawn from the plug magazine. Ideally, such a robotic arm should be length adjustable so that it may be used in different models of steam generators. Such an improved arm should also have some sort of mechanism for disconnecting the plugging tool from the balance of the robotic arm in the event of a jam, so that the arm can be removed from the channel head. Finally, it would be desirable if the tube plug magazine was capable of storing a relatively large number of tube plugs in order to minimize the exposure of maintenance personnel to potentially harmful radiation.

SUMMARY OF THE INVENTION

Generally speaking, the invention is an improved robotic arm which overcomes all of the aforementioned limitations associated with prior art tube plugging arms. The apparatus of the invention is an improved robotic arm for delivering and positioning a plugging tool of the type including a support member, a base arm movably connected to the support member, a plug magazine mounted onto the base arm, a guidance mechanism having the plugging tool mounted thereon for aligning and positioning the plugging tool, and a positioning mechanism movably supported on the base arm for positioning the plugging tool between a tube to be plugged and the plug magazine incident to a plug unloading operation, wherein the improvement comprises a compliance coupling between the tool and the guidance mechanism that is compliant in three dimensions, a length adjustment assembly for adjusting the length of the base arm, an emergency release mechanism for releasing the plugging tool from the arm in the event of a jam, and an improved rotary-type plug magazine capable of storing a relatively large inventory of plugs and unloading these plugs into the plugging tool smoothly and without scratching.

The three dimensional compliance coupling may include a first mounting member connected to the plugging tool, a second mounting member connected to the guidance mechanism, and a plurality of extendable and compressible spring members connected between the first and second mounting members for affording three dimensional movement. In the preferred embodiment, five such spring members are connected between the first and second mounting members. Additionally, guide rods are concentrically disposed within the interiors of each of the spring members in order to provide these members with an optimum balance between resiliency and stiffness.

The length adjustment assembly includes the provision of first and second arm members in the base arm which are slidably movable with respect to each other. In the preferred embodiment, the first and second arm members are channel beams, wherein the second channel beam is slidably movable within the interior of the first channel beam. The second channel beam is provided with a plurality of first channel openings, along its longitudinal axis, while the beam includes an opening that is alignable with each of the plurality of openings in the second beam. The adjustment mechanism further includes a locking pin which is insertable and withdrawable from these openings when they are placed in alignment with one another in order to lock the beams together to form a single beam of a desired length.

The emergency release mechanism is provided between the compliance coupling and the plugging tool so that the plugging tool may be easily removed from the balance of the robotic arm in the event of a jam or a tool malfunction. The release of the plugging tool from the balance of the arm allows the operator of the arm to remove the arm from the man way so that either a maintenance operator or a remote controlled tool can unjam the plugging tool from the tube. In the preferred embodiment, the emergency release includes a lock pin which is insertable into and withdrawable from mutually-alignable bores present in a bayonet-type coupling between the compliance coupling and the plugging tool.

The drum of the rotary-type magazine may include a plurality of spring clips around its periphery for detachably retaining a plurality of tube plugs, as well as a torsional spring for urging the drum to rotate about the bracket which connects it to the base arm. A stop means that is also connected to the base arm serves to stop a plug retained by one of the spring clips around the periphery of the drum at an unloading position relative to the plugging tool. When this tube plug is detached from its spring clip by the plugging tool, the torsional spring advances a second tube plug to the stop means, which again stops the tube plug at the unloading position. The stop means may include a pair of stop members which engage the distal and proximal end of a tube plug retained by one of the spring clips when the torsional spring advances the plug to the unloading position. Rollers may be provided at the ends of each of these stop members to prevent the tube plug from being scratched when it is withdrawn from the spring clip by the plugging tool.

The provision of a compliance coupling having the ability to move in three dimensions advantageously allows the plugging tool to align and insert a tube plug into the mouth of a heat exchanger tube consistently and reliably, and without the generation of stresses which could damage or break the components of the arm. The length adjustability assembly in the base arm allows the arm to service all presently operable models of nuclear steam generators, thereby making the tool much more versatile than other tools used in the prior art. The emergency release mechanism provides an easy way to clear a jam between the plugging tool and a tube. Finally, the use of a rotary-type magazine not only increases the tube-plug inventory of the end effector; it also renders the tube plug unloading operation smoother, more efficient and more reliable without scratching the plugs.

BRIEF DESCRIPTION OF THE SEVERAL FIGURES

Figure 3A:
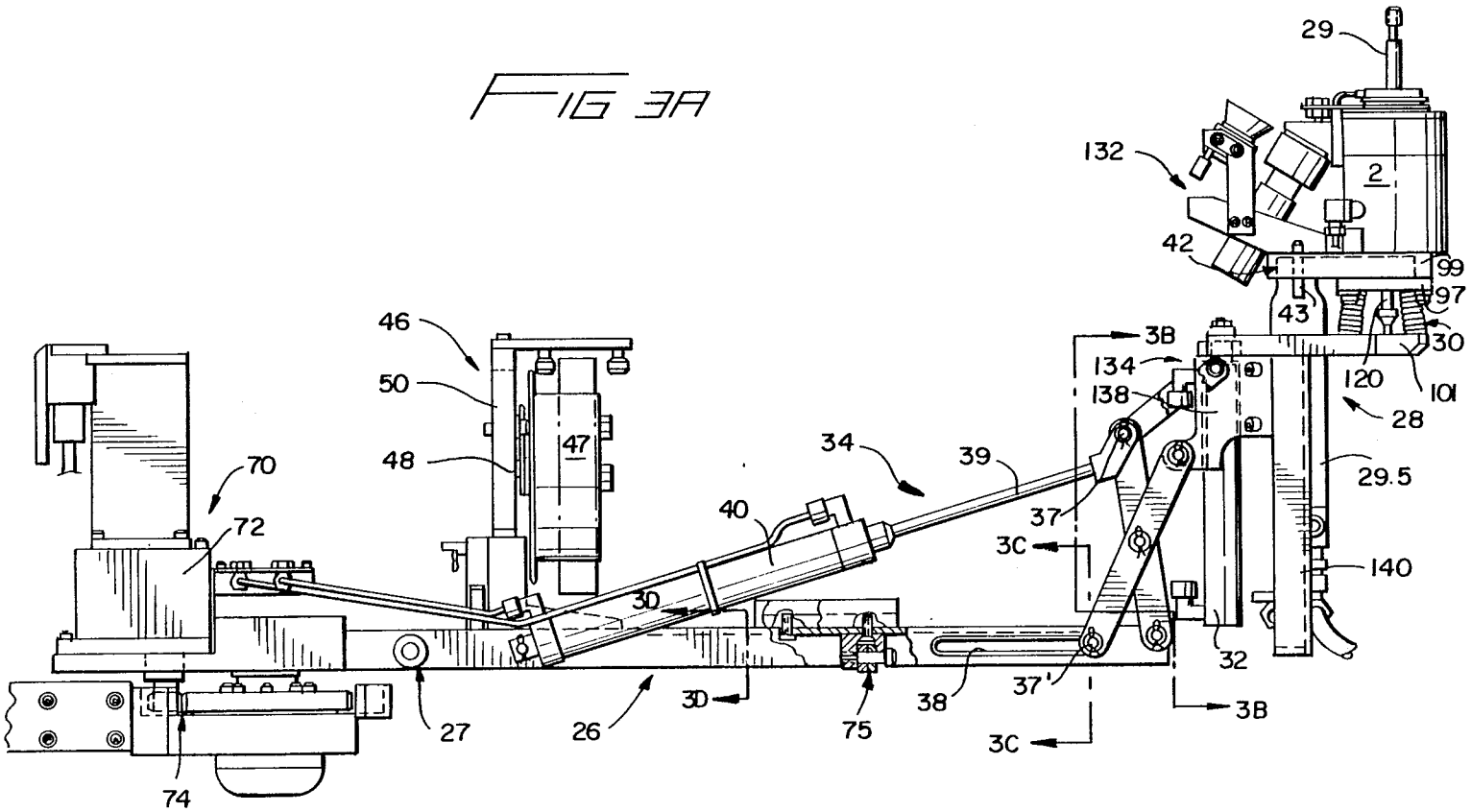
FIG. 3A is an enlarged view of the outer segment of the base arm shown in FIG. 2A, illustrating how the pneumatic cylinder of the positioning mechanism moves the plugging tool from a horizontal, plug-loading position to a vertical plug-installing position.
Figure 3C:
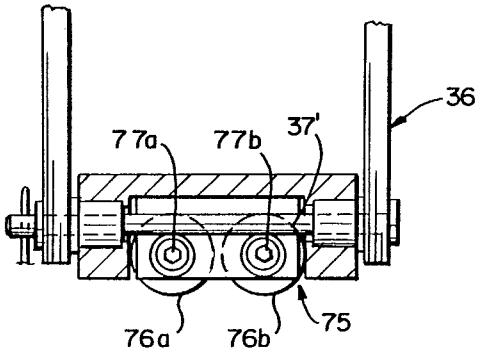
Figure 3D:
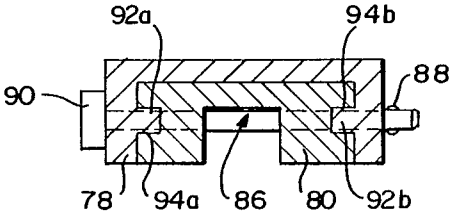
Figure 3B:
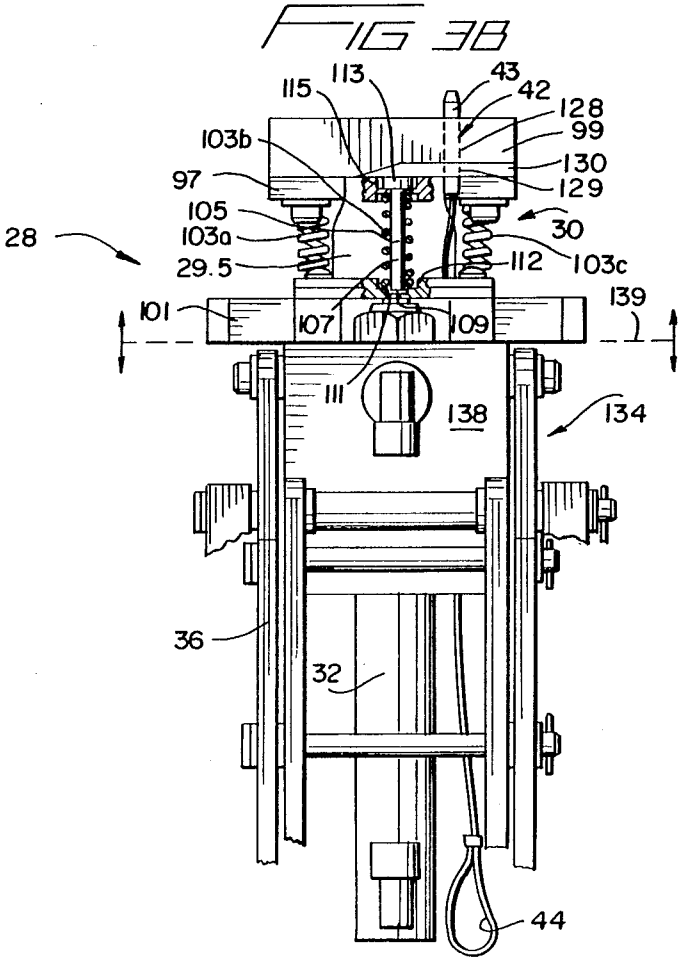
Figure 4B:
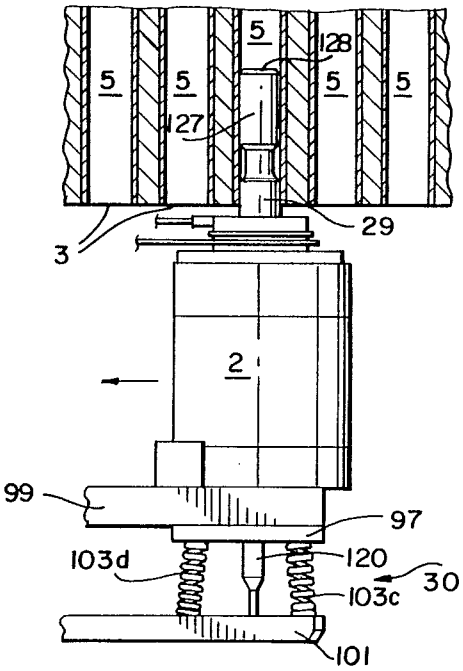
Figure 4A:
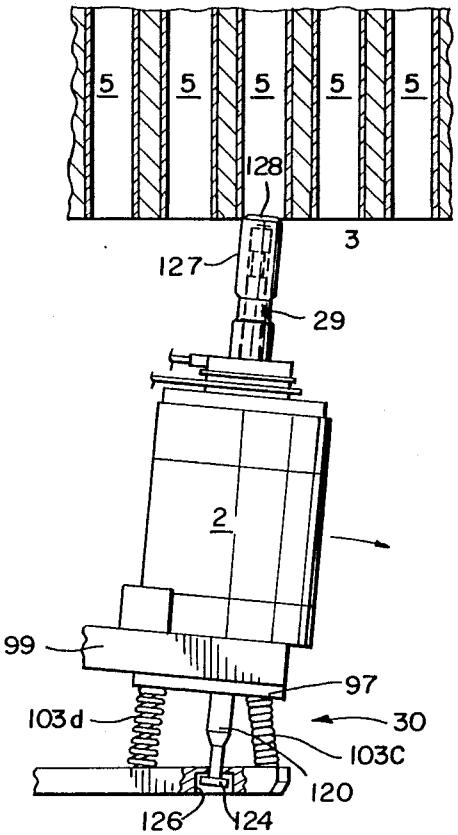
Figure 5B:
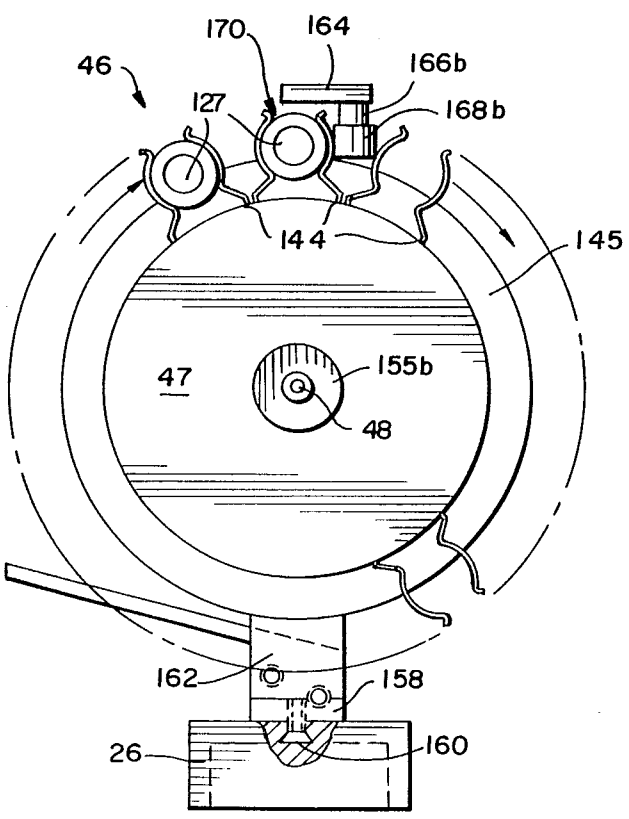
Figure 5A:
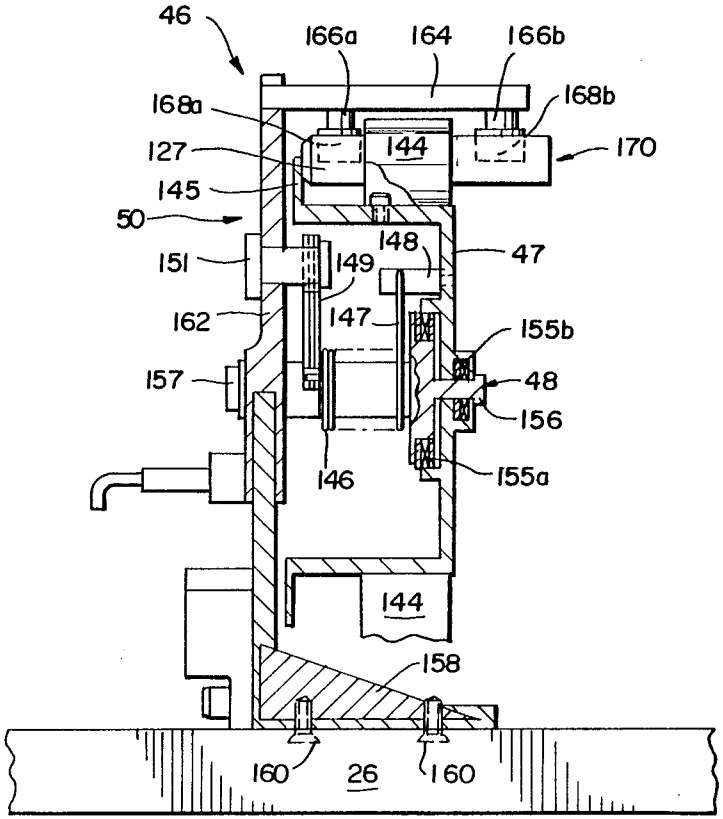

FIG. 3B a back view of the scissors-type linkage used in the positioning mechanism along the line 3B—3B in FIG. 3A;

FIG. 3C is a cross-sectional view of the outer segment of the base arm along the line 3C—3C, illustrating the roller assembly which allows the outer segment of the base arm to rotate over the inner segment of the base arm without mechanical interference;

FIG. 3D is another side view of the outer segment of the base arm illustrated in FIG. 3A along the line 3D—3D, illustrating how the inner and outer beams which form the outer segment of the arm slidably interfit with one another;

FIGS. 4A and 4B are side views of the plugging tool in operation, illustrating how the three-dimensional movement afforded by the spring-type compliant coupling of the guidance mechanism allows the mandrel of the plugging tool to successfully be inserted into the open end of a heat exchanger tube despite a non-perfect alignment therebetween;

FIG. 5A is a cross-sectional side view of the rotary plug magazine of the invention, and FIG. 5B is a front view of the rotary plug magazine illustrated in FIG. 5A.

DETAILED DESCRIPTION OF THE PREFERRED EMBODIMENT

GENERAL OVERVIEW OF THE PREFERRED EMBODIMENT

Figure 1:
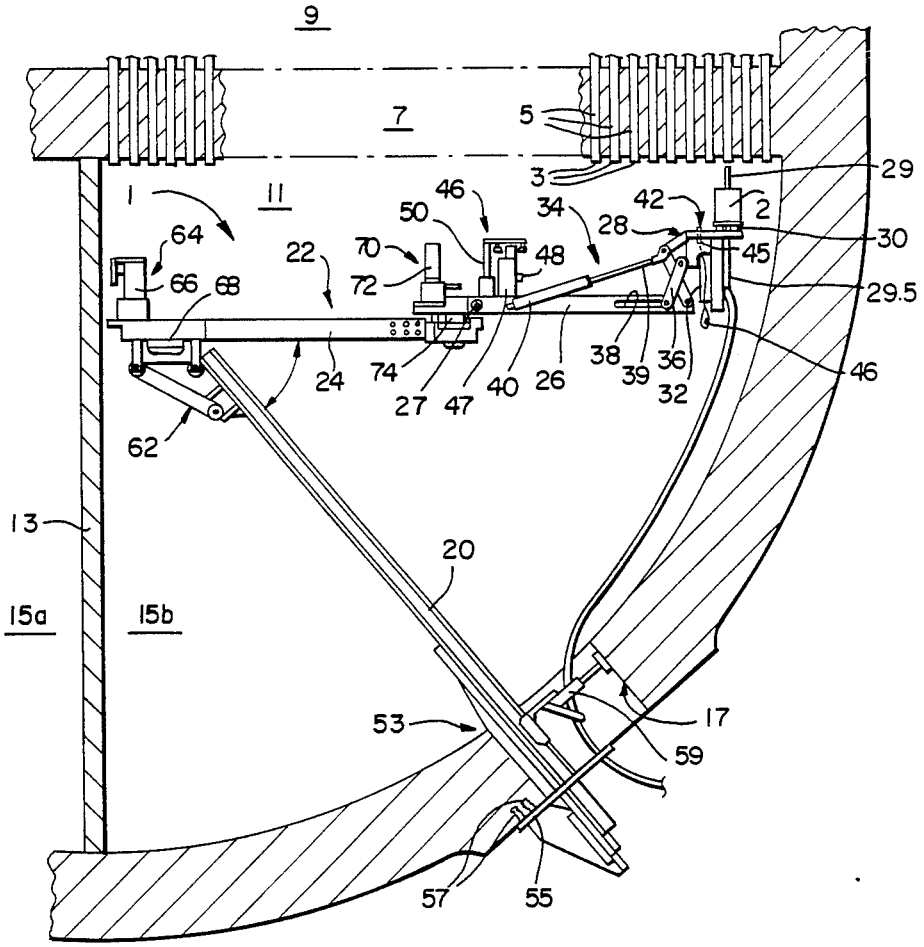
FIG. 1 is a side view of the improved robotic arm of the invention as it would appear in operation within the channel head of a nuclear steam generator.

With reference now to FIG. 1, wherein like components are designated by like reference numerals throughout all of the several figures, the principal purpose of the robotic arm 1 of the invention is to deliver and position a plugging tool 2 to the open ends 3 of selected heat exchanger tubes 5 of a nuclear steam generator, although the use of the arm 1 is not exclusively confined to such. The heat exchanger tubes 5 of such nuclear steam generators are mounted in a tubesheet 7 which hydraulically isolates a secondary side 9 of the generator (which contains nonradioactive water) from the bowl-shaped primary side 11 of the generator (which contains hot, radioactive water that has flowed through the nuclear core of the plant). The bowl-shaped primary side 11 is hydraulically bisected by means of a divider plate 13 which defines a pair of mutually adjacent channel 15*a*,15*b*. Each of these channel heads 15*a*,15*b* includes a man way 17 which allows the robotic arm 1 to be installed within the channel head 15*b* as shown.

Figure 2A:
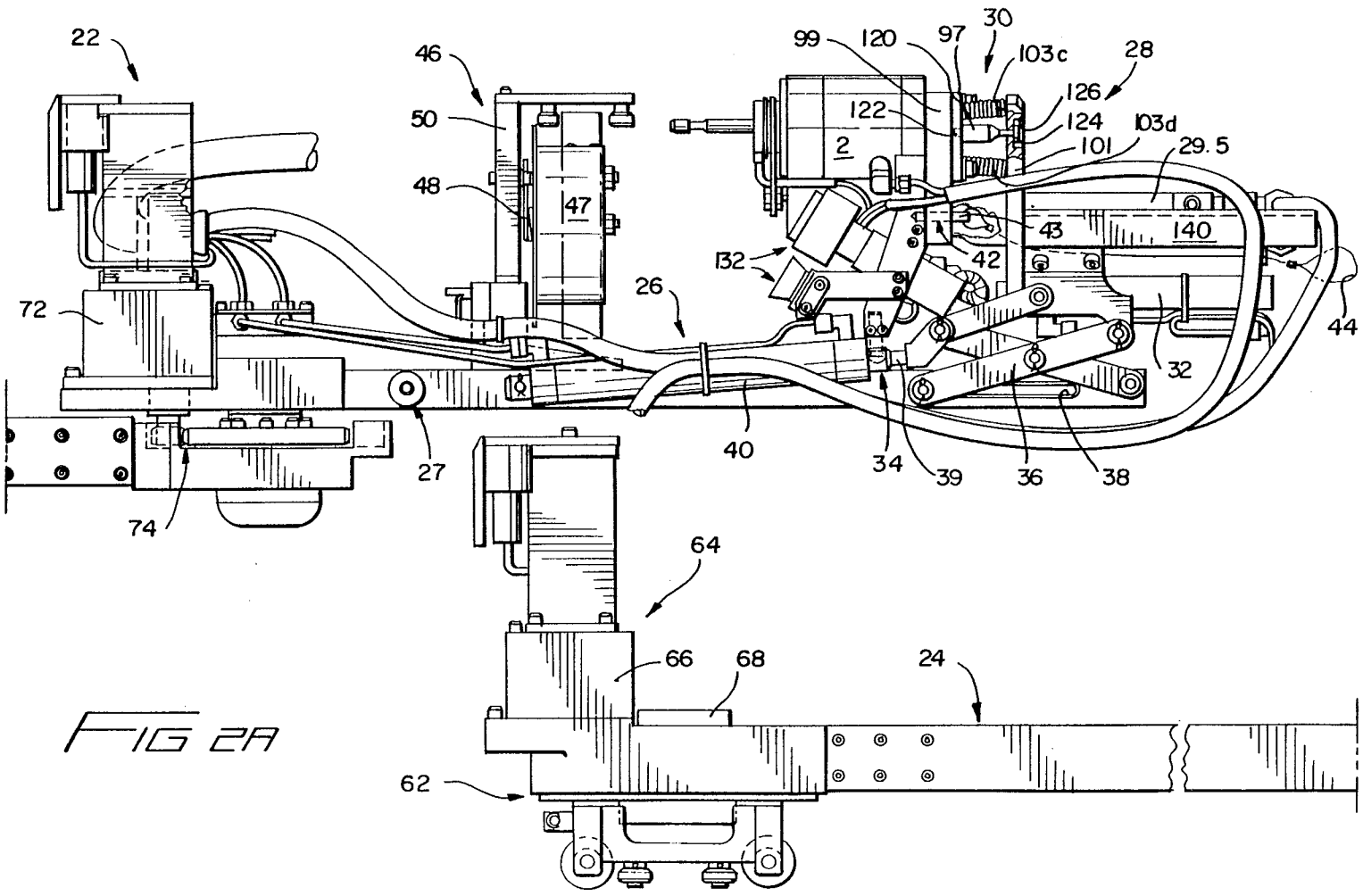
FIG. 2A is a side view of the base arm of the robotic arm of the invention, along with the rotary plug magazine, guidance mechanism and positioning mechanism mounted thereon.
Figure 2B:
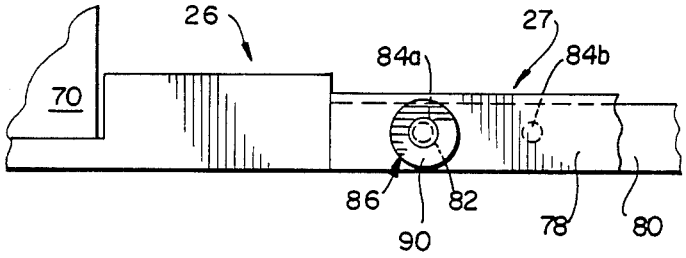
FIGS. 2B and 2C illustrate the length-adjustability assembly of the base arm.
Figure 2C:
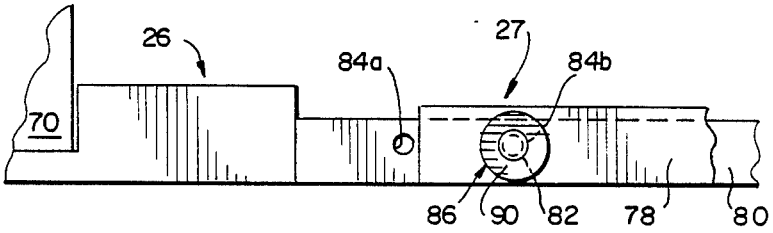

With reference now to FIGS. 1 and 2A, the robotic arm includes a support beam 20 mountable in the man way 17 of the steam generator for supporting a base arm 22 in parallel relationship with the tubesheet 7. The base arm 22 includes an inner segment 24 that is rotatably connected to the base arm 22, and an outer segment 26 that is rotatably connected to the inner segment 24. The outer segment 26 includes a length adjustment assembly 27 for varying the length of the base arm 22 to fit a particular model of steam generator. A guidance mechanism 28 mounted onto the distal end of the outer segment 26 connects the plugging tool 2 to the base arm 22, and further serves to guide and insert the plugging mandrel 29 of the plugging tool 2 (which is powered by an air motor 29.5) to either the open end 3 of a selected heat exchanger tube 5, or a rotary tube plug magazine 46. The guidance mechanism 28 generally includes a compliant coupling 30 capable of three-dimensional movement, as well as an extension and retraction cylinder 32 capable of raising and lowering the plugging tool 2 with respect to the inner segment 24 of the base arm 22 as is indicated by an arrow. A positioning mechanism 34 is also mounted over the outer segment 26 of the base arm 22, and serves to position the plugging tool 2 from a horizontal, plug-loading position illustrated in FIG. 2A to the vertical, plug-installing position illustrated both in FIG. 1 and FIG. 3A. The positioning mechanism 34 includes a scissors-type linkage 36 interconnected by link pins 37. One of these link pins 37′ is slidably engaged with a slot 38 present in the outer segment 26. An extendable and retractable piston rod 39 of a pneumatic cylinder 40 is capable of swinging the linkage 36 ninety degrees which in turn moves the plugging tool 2 between a horizontal and a vertical position. Disposed between the compliant coupling 30 of the guidance mechanism 28 and the plugging tool 2 is an emergency release assembly 42 whose principal components include a release pin 43 connected to a draw cable 44. Located on the proximal end of the outer segment 26 of the base arm 22 is the previously mentioned rotary plug magazine 46. As will be discussed in more detail hereinafter, the rotary plug magazine 46 generally comprises a drum 47 rotatably mounted upon an axle 48 that is in turn connected to the proximal end of the outer segment 26 by means of a bracket 50.

The proximal end of the support beam 20 of the robotic arm 1 is mounted onto the periphery of the man way 17 by arm mounting assembly 53. Mounting assembly 53 includes a mounting plate 55 that is secured onto the bowl-shaped wall of the primary side 11 by means of bolts 57. The mounting assembly 53 further includes a jack 59 disposed between the beam 20 and an opposing wall of the man way 17 for applying a securing, compressive force to the proximal end of the beam 20. A pivotal connection assembly 62 connects the distal end of the beam 20 to the proximal end of the inner segment 24 of the base arm 22. The pivotal movement afforded by the connection assembly 62 allows the robotic arm to be inserted through the relatively narrow man way 17 in a "folded" position. Once the base arm 22 is completely within the channel head 15*b* and the proximal end of the support beam 20 secured onto the periphery of the man way 17, the pivotal connection assembly 62 allows the base arm 22 to be swung out and locked into a position which is substantially parallel with the underside of the tubesheet 7. To afford a broad degree of movement between the plugging tool 2 mounted at the distal end of the space arm 22, the proximal end of the inner segment 24 of the arm 22 is connected to the distal end of the support beam 20 by means of a rotary joint 64. The principal components of the joint 64 are a reversible electric motor 66 whose output is coupled to a drive train 68. Another rotary joint 70 having a reversible electric motor 72 and drive train 74 rotatably connects the distal end of the inner segment 24 with the proximal end of the outer segment 26. As will be discussed in more detail hereinafter, precise movement of the plugging tool 2 is accomplished by remotely controlling the reversible motors 66 and 72 of the rotary joints 64 and 70 while visually monitoring the resulting motion by means of a television camera.

SPECIFIC DESCRIPTION OF THE PREFERRED EMBODIMENT

With references now to FIGS. 2A, 2B, 2C and 3D, the length adjustment assembly 27 is generally formed from an outer arm member 78, and an inner arm member 80 which is slidably engaged to the interior of the outer member 78. The outer arm member 78 includes a bore 82 which extends completely through its sides, while the inner arm member 80 includes at least two bores 84*a*,84*b* spaced along its longitudinal axis as shown. The bore 82 may be slid into alignment with either of the bores 84*a*,84*b*. and is preferably the same diameter. When the bores 82, 84*a* or 84*b* are in alignment, they are capable of receiving a locking pin 88 which prevents the outer and inner arm members 78 and 80 from slidably moving axially with respect to one another. As is best seen with respect to FIG. 3D, the locking pin 88 includes a ball detent 88 on its distal end and a detent release 90 on its proximal end. The detent release 90 is capable of pulling the ball detent 88 flush with the shaft of the pin 86 in a manner known in the prior art in order to facilitate the insertion or removal of the pin 86. In the preferred embodiment, locking pin 86 is a Model No. CL-4-BLP-B-3.08 ball-lock type pin available from Carr Lane Manufacturing Company, located in St. Louis, Mo. As is further best seen in FIG.

3D, the outer arm member 78 includes a pair of parallel flanges 92a,92b in its interior which are slidably captured within complementary slots 94a,94b present in the sides of the inner arm member 80. Such a configuration prevents the outer arm member 78 from bowing out of engagement with the inner arm member 80 in response to the moment arm forces applied to the proximal end of the outer arm member 78 by the weight of the guidance mechanism 28 and plugging tool 2. While only two alternative sets of bores 84a,84b are illustrated as being present in the inner arm member 80, it should be noted that, in practice, a sufficient number of bores will be provided in the inner arm member 80 at whatever spacings are necessary to allow the distal end of the outer segment 26 of the arm 1 to reach the periphery of the tubesheet 7 of whatever model of nuclear steam generator is being serviced.

With reference now to FIGS. 3A and 3B, the three-dimensional compliance coupling 30 of the guidance mechanism 28 generally includes a top plate 97 that is ultimately connected to a base plate 99 which supports the plugging tool 2, as well as a bottom plate 101. Five compression springs 103a–e are connected between the top and bottom plates 97 and 101. Specifically, three uniformly spaced compression springs 103a–103c are connected between the distal ends of the top and bottom plates 97 and 101, while two uniformly spaced compression springs 103d and 103e are connected between the proximal ends of the top and bottom plates 97 and 101. In the preferred embodiment, each of the compression springs 103a–103e has a stiffness rating of 27 pounds per inch. Such a stiffness rating affords enough three-dimensional yieldability to the compliance coupling 30 to allow it to properly insert and deliver a plug without undue binding or jamming, but yet is stiff enough to avoid unnecessary play between the tool 2 and the scissors-type linkage 36 of the positioning mechanism 34.

As is best seen with respect to FIG. 3B, the springs 103a–103e are each captured and retained between the top and bottom plates 97 and 101 by means of spring retainers 105 whose rod-like bodies 107 are concentrically disposed within the springs. Each of the spring retainers 105 includes a free end 109 which is slidably received within a bore 111 present in the bottom plate 101 of the coupling 30. This bore 111 is circumscribed by a broader and shallower spring receiving recess 112 as shown. The upper end of the rod-like body 107 of the spring retainer 105 includes a head 113 which is in turn received within a recess 115 present in the top plate 97 of the coupling 30. Located below the head-receiving recess 115 is a spring-receiving recess 117 identical in size and shape to the spring-receiving recess 112 present in the bottom plate 101. The outer diameter of the rod-like body 107 of each of the spring retainers 105 is deliberately dimensioned to be significantly less than the inner diameter of each of the compression springs 103a–103e so that the spring retainers 105 will perform their function of retaining the springs between the top and bottom plates 97 and 101 without interfering with the three-dimensional movement afforded by these springs. In order to secure the top and bottom plates 97 and 101 of the coupling 30 together without unduly restricting relative movement therebetween, a centrally disposed retainer screw 120 (best seen in FIGS. 2A and 4A) is provided therebetween. At its upper end, this retainer screw 120 includes threads which are screwed into a threaded bore present in the top plate 97 of the compliance coupling 30. At its lower end, this screw 120 includes a head 124 which is loosely received within a cylindrical recess 126 in such a manner as to afford a broad latitude of play between the head 124 and the recess 126. The central location of the retainer screw 120 and the play afforded between the head 124 and recess 126 allows the screw 120 to retain the top and bottom plates 97 and 101 while still allowing one plate to be canted relative to the other plate without interference.

The operation and advantages afforded by the three-dimensional compliance coupling 30 are best appreciated with respect to FIGS. 4A and 4B. In FIG. 4A. the guidance mechanism 28 attempts to insert a plug 127 carried by the plugging mandrel 29 of the tool 2 into the open end 3 of a heat exchanger tube 5 when the mandrel 29 and the tube 5 are clearly out of alignment with one another. As the beveled end 128 of the plug 127 attempts to "lead" the balance of the plug 127 into the tube 5, the compliant coupling 30 allows the entire plugging tool 2 to rotate relative to the bottom plate 101 by the extension of the coil springs 103d and 103e on the proximal side of the plate 101, and by the compression of the coil springs 103a–103c at the distal end of the plate 101. As the insertion of the plug 127 is accomplished, the compliant coupling 30 allows the plugging tool 2 to rotate back into a substantially vertical position, thus converting the extension-compression movement of the spring sets 103d–103e and 103a–103c into an equal amount of shear movement for both sets of springs. In short, it is the rotational movement afforded by the extendibility and compressibility of the springs 103a–103e of the compliant coupling 30 that allows the plugging tool 2 to rotate to and fro during the plug insertion process so that the plug 127 may be delivered and engaged to the open end 3 of a heat exchanger tube 5 without undue binding or jamming, or the generation of excessive stresses on the various components of the guidance mechanism 28.

With reference again to FIG. 3B, the guidance mechanism 28 further includes the previously mentioned emergency release assembly 42. The release pin 43 of the assembly 42 is normally received within mutually alignable bores 128, 129 present in both the base plate 99 of the plugging tool 2, and a lock plate 130 disposed between the base plate 99 and the top plate 97 of the compliant coupling 30. The base plate 99 and lock plate 130 are mutually interconnectable by means of a bayonet-type coupling (not shown) whose components are configured so that a relative rotary movement of between about 5 to 8 degrees between the base plate 99 and the lock plate 130 will release the bayonet coupling. In operation, in the unlikely event that the plugging mandrel 29 of the tool 2 should become jammed within one of the heat exchanger tubes 5 mounted in the tubesheet 7, all the system operator need do is to apply a long handled tool to the loop within the draw cable 44 and pull the release pin 43 clear of both the base plate 99 and the lock plate 130. One or the other of the motors 66, 72 of the rotary joints 64, 70 are then actuated to move the lock plate 130 the requisite 5 to 8 degrees with respect to the base plate 99, thereby freeing the plugging tool 2 from the balance of the guidance mechanism 28. The inner segment 24 and outer segment 26 of the robotic arm 1 are then manipulated into a position that allows the base arm 22 to be folded against the support beam 20, whereupon the entire robotic arm 1 may be easily removed through the man way 17 of the steam generator. The clearing of the man way 17 allows a system operator wearing appropriate protective clothing to enter the channel head 15*b* and to unjam the plugging tool 2 from the tubesheet 7.

The guidance mechanism 28 further includes a television camera assembly 132, and a guide fixture 134. The television camera assembly 132 is mounted onto the base plate 99 and aligned with the mandrel 29 of the tool 2 so that a system operator can remotely monitor the position of the plugging mandrel 29 with respect to either the open end 3 of a heat exchanger tube 5 in the event of a plug installing operation, or with respect to the rotary drum 47 of the rotary plug magazine 46 in the event of a plug loading operation. The guide fixture 134 is located just below the bottom plate 101 of the compliant coupling 30. The purpose of the guide fixture 134 is to insure that the action of the piston rod of the extension and retraction cylinder 32 is smoothly converted into a raising and lowering of the tool 2. The guide fixture 134 includes a housing 138 which is best seen in FIG. 3B. When the piston rod of the cylinder 32 is in its retracted state, the bottom plate 101 rests on top of the housing 138 as shown. However, when the piston rod of the cylinder 32 is extended, the bottom plate 101 of the coupling 30 moves upwardly with respect to the top surface of the housing 138, separating the two components at break line 139. As is best seen with respect to FIG. 3A, the guide fixture 134 further includes a guide rod assembly 140 having at least one guide rod and linear bearing (not shown) for smoothly converting the extension and retraction of the piston rod of the cylinder 32 into reciprocatory movement. Such movement of the compliant coupling 30 and plugging tool 2 is essential not only for the plug installing operation, but also for the plug loading operation.

With reference now to FIGS. 5A and 5B, the rotary plug magazine 46 of the robotic arm 1 is provided with a plurality of plug retaining spring clips 144 around its periphery for detachably retaining a plurality of plugs 127 which is at least twelve in the preferred embodiment. Each of these spring clips 144 includes a pair of opposing, resilient legs which operate not unlike the spring clips commonly used to secure broom handles onto the walls of maintenance closets. As is best seen with respect to FIG. 5A, the spring clips 144 are preferably mounted flush with the outer edge of the drum 47, while an annular retaining flange 145 is integrally connected around the inner edge of the drum 47. The purpose of the retaining flange 145 is to prevent the plugs 127 which are loaded within the spring clips 144 from extending past the upright portion of the bracket 50, which could of course cause mechanical interference between the drum 47 and the bracket 50. Concentrically disposed around the previously mentioned axle 48 of the magazine 46 is a torsion spring 146. The outer end 147 of the spring 146 is loaded against a peg 148 mounted within the interior of the drum 47 as shown, while the inner end 149 of this spring 146 is loaded against a retaining peg 151 secured to the bracket 50. The purpose of the torsion spring 146 is to provide an angular biasing force between the drum 47 and the bracket 50 so that the drum 47 will rotate in a clockwise direction unless stopped by the engagement between a plug 127 and the stop members 166*a*, 166*b*. To insure smooth rotational movement between the drum 47 and the axle 48, bearings 155*a*, 155*b* are provided between the outer end of the axle 156 and the central outer portion of the drum 47. The inner end 157 of the axle 48 is rigidly secured to the bracket 50 as indicated.

The bracket 50 which rotatably mounts the drum 47 to the outer segment 26 of the base arm 22 generally includes a base portion 158 secured to the outer segment 26 by means of screws 160, an upright portion 162 to which the axle 48 is fixedly mounted upon, and an overhanging portion 163 for mounting the previously mentioned stop members 166*a*, 166*b*. Each of the stop members 166*a*, 166*b* in turn includes a roller 168*a*, 168*b* to prevent scratching or binding from occurring between the plug 127 and the stop members 166*a*,166*b* when the cylinder 32 of the guidance mechanism 28 withdraws the plugging mandrel 29 of the tool 2 from the plug loading position 170.

As is evident from the previous description, the withdrawal of a plug 127 from a spring clip 144 at the plug loading position 170 will allow the torsion applied to the drum 47 by the spring 146 to move the drum 47 clockwise until another plug 127 engages the stop members 166*a*, 166*b* at the plug loading position 170.

What is claimed is:

1. An improved apparatus for delivering a tool designed for plugging a defective heat exchanger tube in a steam generator, said apparatus being of the type including a support member, a plug magazine mounted on the base arm for storing and unloading tube plugs, a guidance mechanism having said tool mounted thereon for aligning and positioning said tool relative to a selected tube to be plugged, a positioning mechanism movably supported on said base arm and having said guidance mechanism mounted thereon for positioning said tool between said selected tube and said plug magazine incident to a plug unloading operation, wherein the improvement comprises a compliance coupling between said tool and said guidance mechanism that is compliant in three dimensions, including a first mounting member connected to said tool, a second mounting member connected to said guidance mechanism, and a plurality of extendible and compressible spring members connected between said first and second mounting members such that the compliance coupling exhibits both a high lateral flexibility and a high axial flexibility so that the plug may be axially aligned with the defective heat exchanger tube.

2. An improved apparatus as described in claim 1, wherein the spring members have a stiffness rating of between 24 and 30 pounds per inch.

3. An improved apparatus as described in claim 1, wherein the improvement comprises a rotary plug magazine including a drum means rotatably mounted on a bracket means that is connected to said base arm.

4. An improved apparatus for delivering a tool designed for plugging a defective heat exchanger tube in a steam generator, said apparatus being of the type including a support member, a base arm movably connected to the support member, a plug magazine mounted on the base arm for storing and unloading tube plugs, a guidance mechanism having said tool mounted thereon for aligning and positioning said tool relative to a selected tube to be plugged, a positioning mechanism movably supported on said base arm and having said guidance mechanism mounted thereon for positioning said tool between said selected tube and said plug magazine incident to a plug unloading operation, wherein the improvement comprises means for adjusting the length of said base arm and a compliance coupling between said tool and said guidance mechanism that is compliant in three dimensions and includes a first mounting member connected to said tool, a second mounting member connected to said guidance mechanism, and a plurality of extendible and compressible spring members connected between said first and second mounting members such that the compliance coupling exhibits both a high lateral flexibility and a high axial flexibility so that the plug may be axially aligned with the defective heat exchanger tube.

5. An improved apparatus as described in claim 4, wherein said base arm includes first and second arm members slidably movable with respect to each other, and said means for adjusting the length of said base arm includes means for interlocking said arm member.

6. An improved apparatus as described in claim 5, wherein said means for interlocking said arm members includes a plurality of mutually registrable openings in both said arm members, and at least one pin means receivable within said mutually registrable openings.

7. An improved apparatus as described in claim 5, wherein both said first and second arm members includes U-shaped cross sections, and wherein said second arm member is receivable in the interior of the first arm member.

8. An improved apparatus as described in claim 5, wherein said means for interlocking said arm members includes a plurality of mutually registrable openings between both said arm members, and at least one pin means receivable within said mutually registrable openings.

9. An improved apparatus as described in claim 4, wherein said improvement further comprises a release means for releasing said tool from said guidance mechanism.

10. An improved apparatus for delivering a tool designed for plugging a defective heat exchanger tube in a steam generator, said apparatus being of the type including a support member, a base arm movably connected to the support member, a plug magazine mounted on the base arm for storing and unloading tube plugs, a guidance mechanism having said tool mounted thereon for aligning and positioning said tool relative to a selected tube to be plugged, a positioning mechanism movably supported on said base arm and having said guidance mechanism mounted thereon for positioning said tool between said selected tube and said plug magazine incident to a plug unloading operation, wherein the improvement comprises a rotary plug magazine including a bracket means mounted onto said base arm, and a drum means rotatably mounted on said bracket means for retaining a plurality of the plugs.

11. An improved apparatus as described in claim 10, wherein said drum means of said rotary plug magazine includes a plurality of clip means around its periphery for detachably retaining a plurality of tube plugs.

12. An improved apparatus as described in claim 11, wherein said drum means of said rotary plug magazine includes means for applying a torsional force to said drum means relative to said bracket means.

13. An improved apparatus as described in claim 12, wherein said rotary plug magazine includes a stop means for counteracting the torsional force applied to said drum means.

14. An improved apparatus as described in claim 13, wherein said stop means stops a first tube plug retained by one of said clip means at an unloading position relative to said plugging tool, and wherein said torsional force member advances a second tube plug to said unloading position after said first tube plug is detached from its respective clip by said plugging tool.

15. An improved apparatus for delivering a tool designed for plugging a defective heat exchanger tube in a steam generator, said apparatus being of the type including a support member, a base arm movably connected to the support member, a plug magazine mounted on the base arm for storing and unloading tube plugs, a guidance mechanism having said tool mounted thereon for aligning and positioning said tool relative to a selected tube to be plugged, a positioning mechanism movably supported on said base arm and having said guidance mechanism mounted thereon for positioning said tool between said selected tube and said plug magazine incident to a plug unloading operation, wherein the improvement comprises:

a compliance coupling between said tool and said guidance mechanism that includes a first mounting member connected to said plugging tool, a second mounting member connected to said guidance mechanism, and a plurality of extendable and compressible spring members connected between said first and second members for rendering said coupling compliant in three dimensions, and a rotary plug magazine including a bracket mounted onto said base arm, a drum means rotatably mounted on said bracket means having a plurality of clip means around its periphery for detachably retaining a plurality of tube plugs, a torsional spring means for urging said drum means to rotate about said bracket, a stop means for counteracting the torsional force applied to said drum means by said spring means, wherein said stop means stops a first tube plug retained by one of said clip means at an unloading position relative to said plugging tool, and wherein said torsional spring means advances a second tube plug to said unloading position after said first tube plug is detached from its respective clip by said plugging tool.

16. An improved apparatus as described in claim 15, wherein the improvement further comprises means for adjusting the length of the base arm of the apparatus, said adjustment means comprising the provision of first and second arm members in said base arm that are slidably movable with respect to one another, a plurality of mutually registrable openings in each of said arm members, and a pin means receivable within said openings when said openings are aligned into registration with one another for interlocking said first and second arm members.

17. An improved apparatus as described in claim 15, wherein said improvement further comprises a release means for releasing said tool from said guidance mechanism, including a locking pin that detachably secures said tool to said compliance coupling, said locking pin being receivable into and removable out of mutually alignable bores in said tool and said coupling to secure and detach said tool and said coupling, respectively.

18. An improved apparatus as described in claim 15, wherein said stop means includes first and second stop members, each of which includes a roller means for minimizing friction between the stop members and the tube plug when a tube plug in said unloading position is withdrawn from its respective clip by said plugging tool.

19. An improved apparatus as described in claim 16, wherein said first and second arm members are channel beams having a U-shaped cross section, and wherein said second arm member is slidably receivable within said first arm member.

* * * * *